US012188227B2

(12) United States Patent
Esposito

(10) Patent No.: US 12,188,227 B2
(45) Date of Patent: Jan. 7, 2025

(54) COMPOSITE SANDWICH PANEL AND WALL SYSTEM THEREWITH

(71) Applicant: Mesocore, LLC, Riveria Beach, FL (US)

(72) Inventor: Joseph Esposito, Huntington Bay, NY (US)

(73) Assignee: Mesocore, LLC, Riveria Beach, FL (US)

( * ) Notice: Subject to any disclaimer, the term of this patent is extended or adjusted under 35 U.S.C. 154(b) by 0 days.

(21) Appl. No.: 17/768,127

(22) PCT Filed: Oct. 8, 2020

(86) PCT No.: PCT/US2020/054735
§ 371 (c)(1),
(2) Date: Apr. 11, 2022

(87) PCT Pub. No.: WO2021/076392
PCT Pub. Date: Apr. 22, 2021

(65) Prior Publication Data

US 2024/0295118 A1 Sep. 5, 2024

Related U.S. Application Data

(60) Provisional application No. 62/915,146, filed on Oct. 15, 2019.

(51) Int. Cl.

| | |
|---|---|
| ***E04B 1/14*** | (2006.01) |
| ***E04B 2/00*** | (2006.01) |
| ***E04B 2/08*** | (2006.01) |
| ***E04B 2/58*** | (2006.01) |

(52) U.S. Cl.
CPC ..... *E04B 2/08* (2013.01); *E04B 1/14* (2013.01); *E04B 2/58* (2013.01)

(58) Field of Classification Search
CPC . E04B 1/14; E04B 1/7608; E04B 1/80; E04B 2/58; E04B 2/7425; E04B 2001/2481; E04B 2002/567; E04B 7/22; E04C 2/24; E04C 2/243; E04C 2/246; E04C 2/26; E04C 2/28; E04C 2/284; E04C 2/292; E04C 2/296; E04C 2/30; E04C 2/34; E04C 2/46
See application file for complete search history.

(56) References Cited

U.S. PATENT DOCUMENTS 2,851,730 A * 9/1958 Wilhelmi ..... E04C 2/243 428/326
3,665,664 A * 5/1972 Watson ..... E04B 1/14 52/211
4,067,165 A * 1/1978 Timmons ..... E04B 2/7425 52/282.4
4,073,998 A * 2/1978 O'Connor ..... B32B 15/20 428/920

(Continued)

FOREIGN PATENT DOCUMENTS

EP 2837749 A1 * 2/2015 ..... E04B 1/14
WO WO-9738178 A1 * 10/1997 ..... E04B 1/14

(Continued)

*Primary Examiner* — Kyle J. Walraed-Sullivan
(74) *Attorney, Agent, or Firm* — Dilworth & Barrese, LLP

(57) ABSTRACT

An improved composite sandwich panel and wall system enhances assembly of prefabricated components to form both a secure and uncomplicated wall structure.

6 Claims, 6 Drawing Sheets

(56) References Cited

U.S. PATENT DOCUMENTS 4,567,698 A * 2/1986 Morrison ..... E04B 2/74 52/36.6
4,799,349 A * 1/1989 Luckanuck ..... E06B 5/16 428/921
4,852,310 A * 8/1989 Henley ..... E04B 1/74 52/404.3
5,081,810 A * 1/1992 Emmert ..... E04C 2/36 52/794.1
5,194,323 A * 3/1993 Savoy ..... B32B 27/302 428/317.1
5,270,108 A * 12/1993 Savoy ..... A01N 59/14 428/305.5
5,701,708 A * 12/1997 Taraba ..... E04B 1/14 52/223.7
5,722,213 A * 3/1998 Morency ..... E06B 3/822 427/397.8
5,787,665 A * 8/1998 Carlin ..... E04B 2/7453 52/309.4
5,822,940 A * 10/1998 Carlin ..... E04B 2/7453 52/459
5,927,032 A * 7/1999 Record ..... E04C 2/288 52/412
6,584,742 B1 * 7/2003 Kligler ..... E04B 2/58 52/309.7
6,679,021 B2 * 1/2004 Maimon ..... E04C 2/296 52/592.1
6,824,851 B1 * 11/2004 Locher ..... B29C 70/34 428/72
8,065,846 B2 11/2011 McDonald et al.
8,151,539 B2 * 4/2012 Grinsted ..... E04C 2/205 52/745.1
10,264,882 B1 * 4/2019 Lai ..... A47B 96/04
10,731,339 B2 * 8/2020 Hauserman-Winder ..... E04B 2/7453
10,829,929 B1 * 11/2020 Hansen ..... E04B 1/6162
11,220,820 B2 * 1/2022 Du ..... E04B 1/388
12,037,788 B2 * 7/2024 Bennett ..... E04C 2/02
2002/0129574 A1 * 9/2002 Newhouse ..... B25B 5/003 52/239
2004/0226247 A1 * 11/2004 Byrd ..... E04D 3/358 52/518
2005/0050847 A1 * 3/2005 Lott ..... E04C 3/28 52/782.1
2006/0080913 A1 * 4/2006 Lima ..... E04C 2/386 52/204.1
2007/0094963 A1 * 5/2007 McDonald ..... E04B 5/10 52/270
2007/0130866 A1 * 6/2007 Lott ..... E04C 2/246 52/481.1
2007/0245640 A1 * 10/2007 Bergqvist ..... E04C 2/288 52/92.2
2007/0251181 A1 * 11/2007 Dupont ..... E04F 13/0805 52/586.1
2008/0127594 A1 * 6/2008 Kennedy ..... B32B 3/26 52/630
2009/0126299 A1 * 5/2009 Rozhkov ..... E04C 2/296 52/309.4
2009/0205277 A1 * 8/2009 Gibson ..... E04D 13/1625 52/656.1
2009/0255213 A1 * 10/2009 Schwartau ..... B29C 66/14 52/794.1
2009/0313926 A1 * 12/2009 Schwartau ..... E04B 1/14 52/274
2009/0313931 A1 * 12/2009 Porter ..... B32B 21/02 52/309.3
2010/0126103 A1 * 5/2010 diGirolamo ..... E04B 2/767 52/655.1
2011/0020599 A1 * 1/2011 Le Roy ..... D04H 1/498 28/104
2011/0049935 A1 * 3/2011 Locher ..... B66B 11/0226 296/193.07
2011/0099929 A1 * 5/2011 Liegeois ..... E04B 2/7425 52/582.1
2016/0222651 A1 * 8/2016 MacKinlay ..... E04C 2/288
2016/0237683 A1 * 8/2016 Husin-Ali ..... E04C 2/284
2019/0292773 A1 * 9/2019 Gombar ..... E04B 1/806
2020/0002934 A1 * 1/2020 McCarron ..... E04B 1/2403
2023/0323730 A1 * 10/2023 Aurand ..... E05C 1/04 49/445
2023/0399551 A1 * 12/2023 Fellinger ..... C09J 129/04
2024/0149578 A1 * 5/2024 McQuerrey ..... B30B 5/06

FOREIGN PATENT DOCUMENTS

WO WO-0107725 A1 * 2/2001 ..... C04B 28/02
WO WO-02081835 A1 * 10/2002 ..... B32B 13/02

* cited by examiner

COMPOSITE SANDWICH PANEL AND WALL SYSTEM THEREWITH

BACKGROUND OF THE INVENTION

The present invention is directed to an improved system for building a wall from prefabricated components suitable for an exterior, insulated, weatherproof structural or non-structural building envelope. The system of the present invention can be easily assembled or disassembled as required, and effectively form a wall structure.

SUMMARY OF THE INVENTION

Accordingly, it is an object of the present invention to improve constructing with prefabricated components.

It is a more specific object of the present invention to simplify construction with prefabricated components.

It is another object of the present invention to provide prefabricated components which can easily interlock with one another to form a secure wall structure upon assembly.

These and other objects are attained by the present invention which is directed to a composite sandwich panel and structural framing which can be used to form and construct a wall system in a facilitated manner, and which effectively insulates and fireproofs. This is realized with a panel having a middle inner board formed of rigid insulating material with a notch or channel extending around a periphery thereof. An outer board is laminated to the middle inner board. Scrim is laminated to opposite outer sides of the middle inner board, with adhesive laminating the scrim, the middle inner board and outer board. Additionally, a tongue insert is directed into the notch or channel of the middle inner board for assembling the wall system.

More particularly, the wall system comprises a series of these panels and tongue inserts, in addition to a channel sill and hollow steel structural tubes of rectangular or square cross-section, which abut adjacent panels when the panels and tubes are received in the sill. The tubes are configured to be secured to one another at respective endplates.

The composite sandwich panel is sufficiently lightweight to allow each component be lifted and placed into position by a single worker. Sandwich panels can be made thin, and not bulky to facilitate shipment. Such panels have a perimeter notch on all four edges to encase the structural frame system.

Additionally, the overall structural framework is light and easy to ship and handle by a single worker, and can easily vary in strength by calibrating wall thickness of the hollow structural steel tube (HSST) without need to alter or change any connections, components or details. A unique assembly sequence locks the framework and panels together. Fasteners are placed only to connect the steel structural frame without need to pierce the panels with fasteners, making the panels stronger with no stress points at the fasteners, and allowing fragile coverings on the panels such as glass, ceramics and smooth metal not pinched by fasteners. An additional layer of covering is not required to achieve a seamless wall or produce a fire barrier separating the insulation from the room. Any damage to the system can be easily repaired. A prefabricated wall system is provided which delivers a desirably smooth, seamless, finished surface which can be easily painted.

BRIEF DESCRIPTION OF THE DRAWINGS

The present invention will be described in greater detail with reference to the accompanying drawings in which.

DESCRIPTION OF THE PREFERRED EMBODIMENTS

Figure 1A:
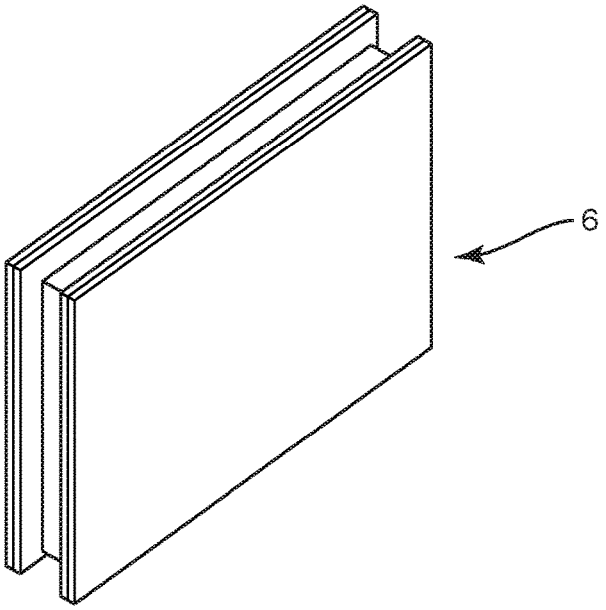
FIG. 1A is perspective view of the composite sandwich panel according to the present invention.
Figure 1B:
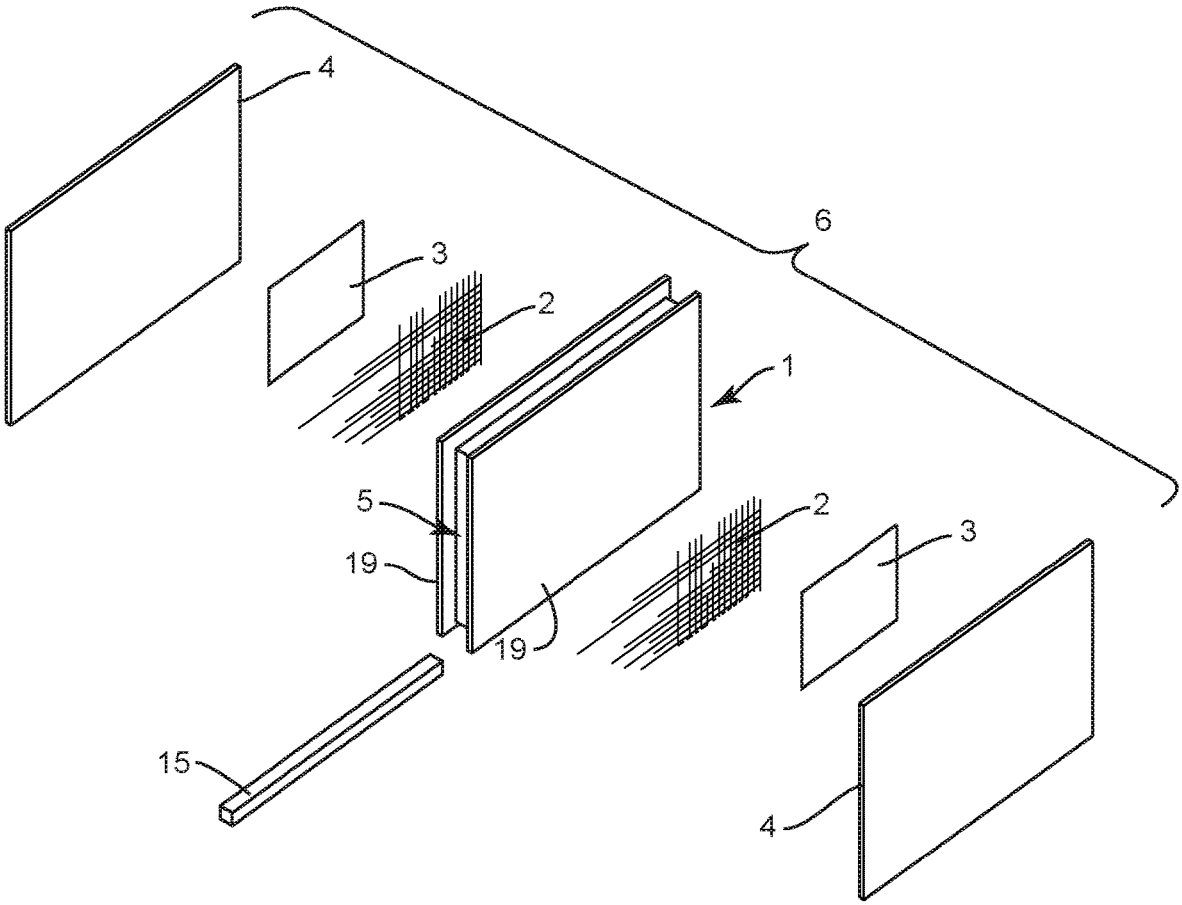
FIG. 1B is an exploded, perspective view illustrating the various components forming the composite sandwich panel of the present invention.

Referring to the drawings, FIG. 1 illustrates a composite sandwich panel 6 in accordance with the present invention having a middle inner, rectangularly-shaped board 1 formed of rigid insulating material and, in turn, having a notch or recess 5 extending around the periphery thereof between two outer opposite sides 19 of the board which form tongues. Scrim 2 is laminated to these outer opposite sides of the middle inner board 1, with two outer boards 4 then laminated to the outer sides of the inner board on top of the scrim 2. More particularly, adhesive 3, e.g., of moisture-cured polyurethane, is used to laminate the scrim to the middle inner board 1. Reference numeral 15 denotes a tongue insert which is inserted into the notches 5 of adjacent panels 6 for coupling the panels 6 together, as described further infra.

The strength of the completed panel 6 can be adjusted by the selection of the individual components. The rigid insulating middle board 1 is generally made of foam plastic of polystyrene or polyurethane, in densities from one to 2½ pounds, and in varying overall thicknesses, makes up the center of the panel. The notch or channel 5 (which enhances design guidance and the alignment of adjacent panels 6) around the perimeter edge of the rigid insulating board creates a tight fit to sizes of hollow steel structural tubes (HSST) 7 and 8, ultimately inserted between the panels 6. The outer boards 4 can each be formed of magnesium oxide composite or any other material of varying thickness. The tongue insert 15 will be inserted into the notch or channel 5 in certain positions of the composite panel 6 occurring in the layout of the wall system. In this regard, the size, shape, thickness and strength of the composite panel 6 can be made to fit the requirements of the wall layout.

Figure 2:
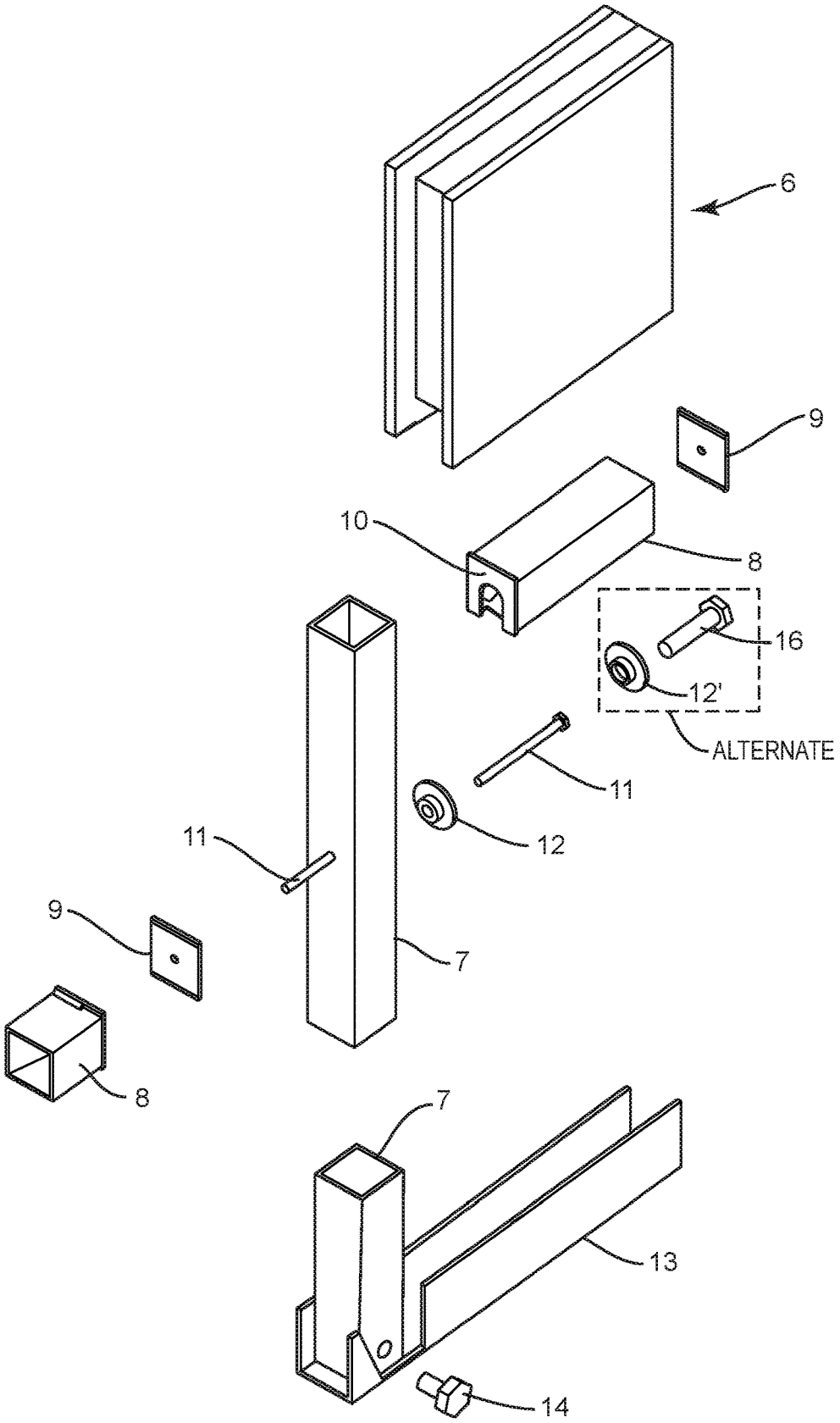
FIG. 2 illustrates an exploded, perspective view schematically illustrating assembling the various components forming the structural framework of the present invention.

Referring to FIG. 2, assembly of the wall system from the individual composite sandwich panels 6 is illustrated. More particularly, the wall system includes steel, aluminum or other structural materials which are integrated or locked together and include the panel 6 in a system which is simple and structurally sound as shown. Firstly, the channel sill 13 is laid out to the desired wall configuration and structurally secured to the floor or slab. The main structural members are constituted by the vertical HSST 7 and the horizontal HSST 8 which connect with one another and other hardware, in accordance with specific fabrications. These structural members can vary in size and in wall thickness to achieve required strength. The vertical HSST 7 may have pre-drilled holes as shown, to facilitate assembly. Among other places, the vertical HSST 7 is attached to the channel sill 13 with bolt 14, as shown in FIG. 2.

The horizontal HSST 8 has an end plate welded to each end. At one end of the horizontal HSST 8, a keyhole end plate 10 is configured to slide over a stepped washer 12 which is secured by a bolt 11 which extends through the vertical HSST 7 and is firmly secured to the welded plate of the horizontal HSST 8 of the adjacent bay. This system facilitates the assembly of the wall system by effecting three structural connections of the framework with one bolt. It also locks in the composite panel 6 in the exact proper position without the need for fasteners through the panel 6. At the opposite end of the horizontal HSST 8, a rounded hole end plate 9 is welded, facilitating the above assembly. This is illustrated as condition B in FIG. 3A.

Figure 3A:
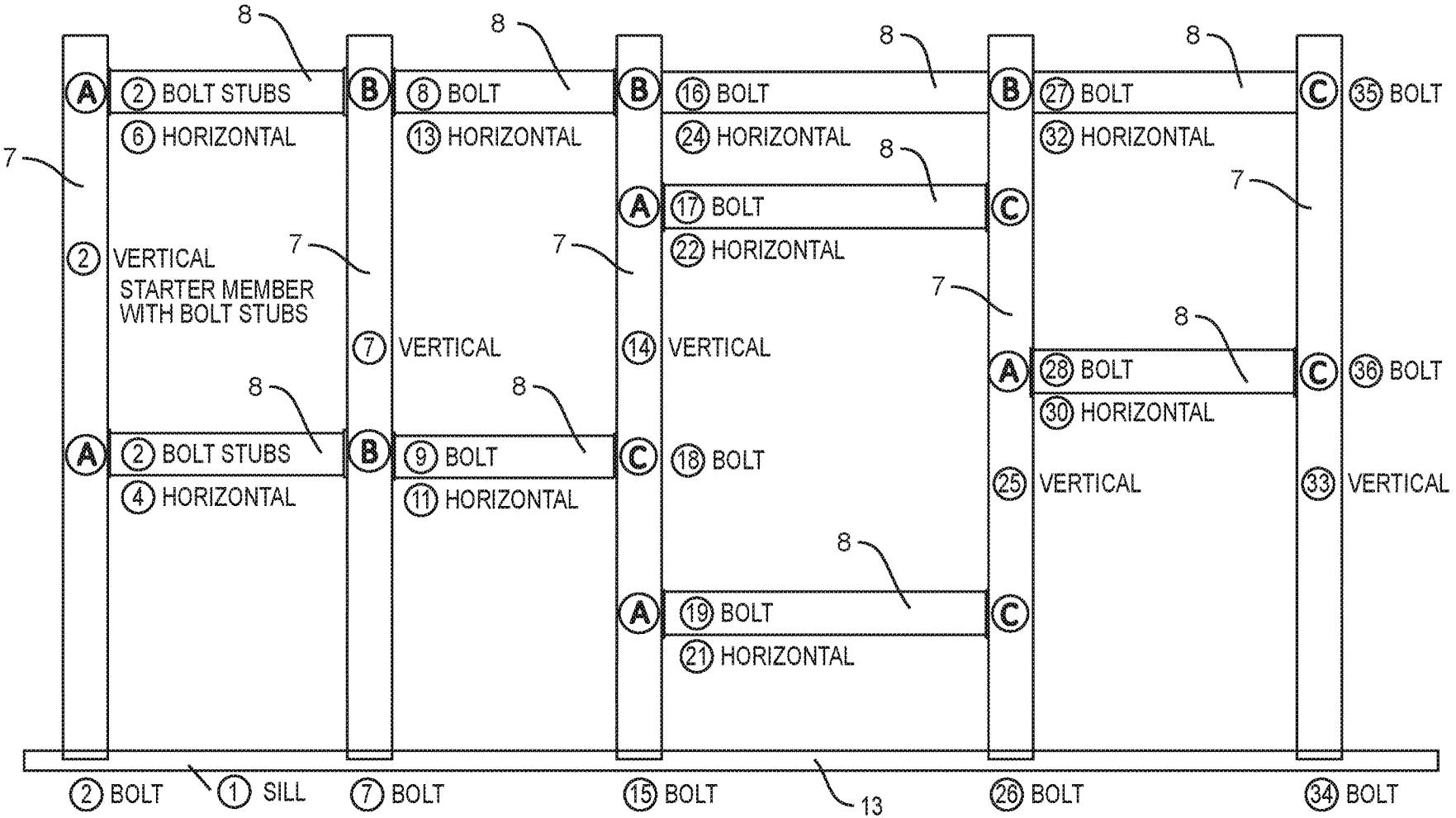
FIG. 3A illustrates a front, elevational view schematically showing assembly of the various support components of the structural framework with the sandwich panels omitted for clarity.

An alternative connection is also illustrated in FIG. 3A where vertical HSST 7 forms the wall assembly that does not have a corresponding horizontal in the preceding bay (as shown in condition A in FIG. 3A). In this situation, the washer 12' is secured to the single wall of the vertical HSST 7 with a bolt 16. In this alternate attachment, in which there is no opposing horizontal HSST 8, the bolt 16 will be larger so that it can securely tap into the vertical HSST 7 pre-drilled holes, creating the same detail with the stepped washer 12 for the next horizontal HSST 8 to engage.

Figure 3B:
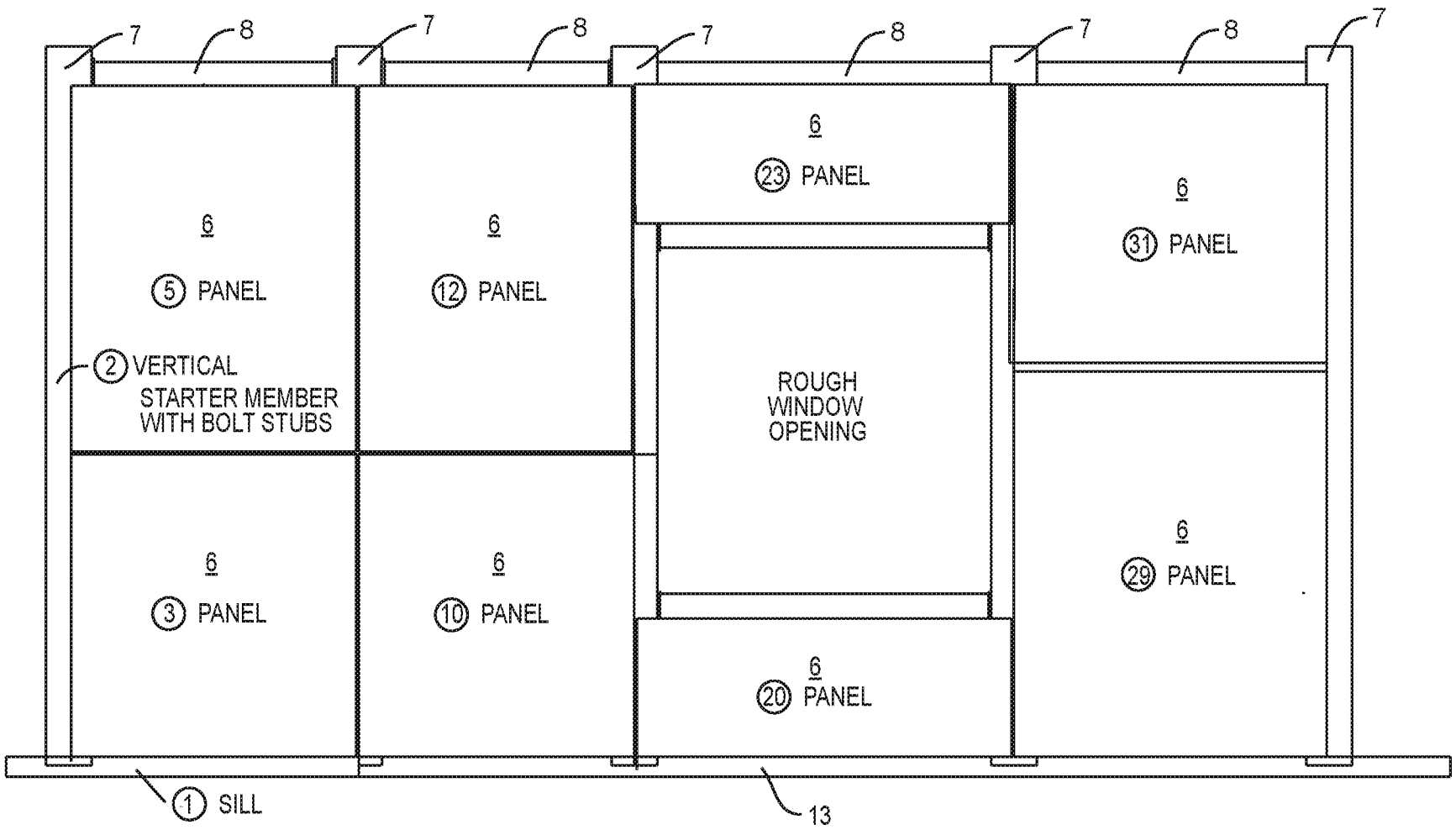
FIG. 3B illustrates a front, elevational view similar to FIG. 3A and showing the assembled sandwich panels on the structural framework of FIG. 3A to form a wall system in accordance with the present invention.

Additionally, condition C is shown in FIG. 3A, when there is a need to prevent the bolt head from protruding into the opening, such as to create a rough opening for a window. In this instance, the stepped washer 12 is not used and the head of bolt 11 is secured inside, on the inner wall of the vertical HSST 7 through an enlarged access hole on the outer wall of vertical HSST 7. As shown in FIG. 3B, after the vertical and horizontal HSSTs 7 and 8 are all secured together, the composite panels 6 can then be assembled onto the skeletal structure. The panels 6 can easily be assembled in sequence according to the numbers illustrated in FIG. 3B, starting with the lowest numbered panel 6. In this illustrated embodiment, one sill 13, five vertical HSSTs 7, eight panels 6, nine horizontal HSSTs 8 and fourteen bolts 11 are shown and utilized. Sealant can then be applied after all adjacent panels are assembled.

The framework components and sandwich panels are assembled together in the order reflected by the encircled numbers in FIGS. 3A and 3B.

Figure 4:
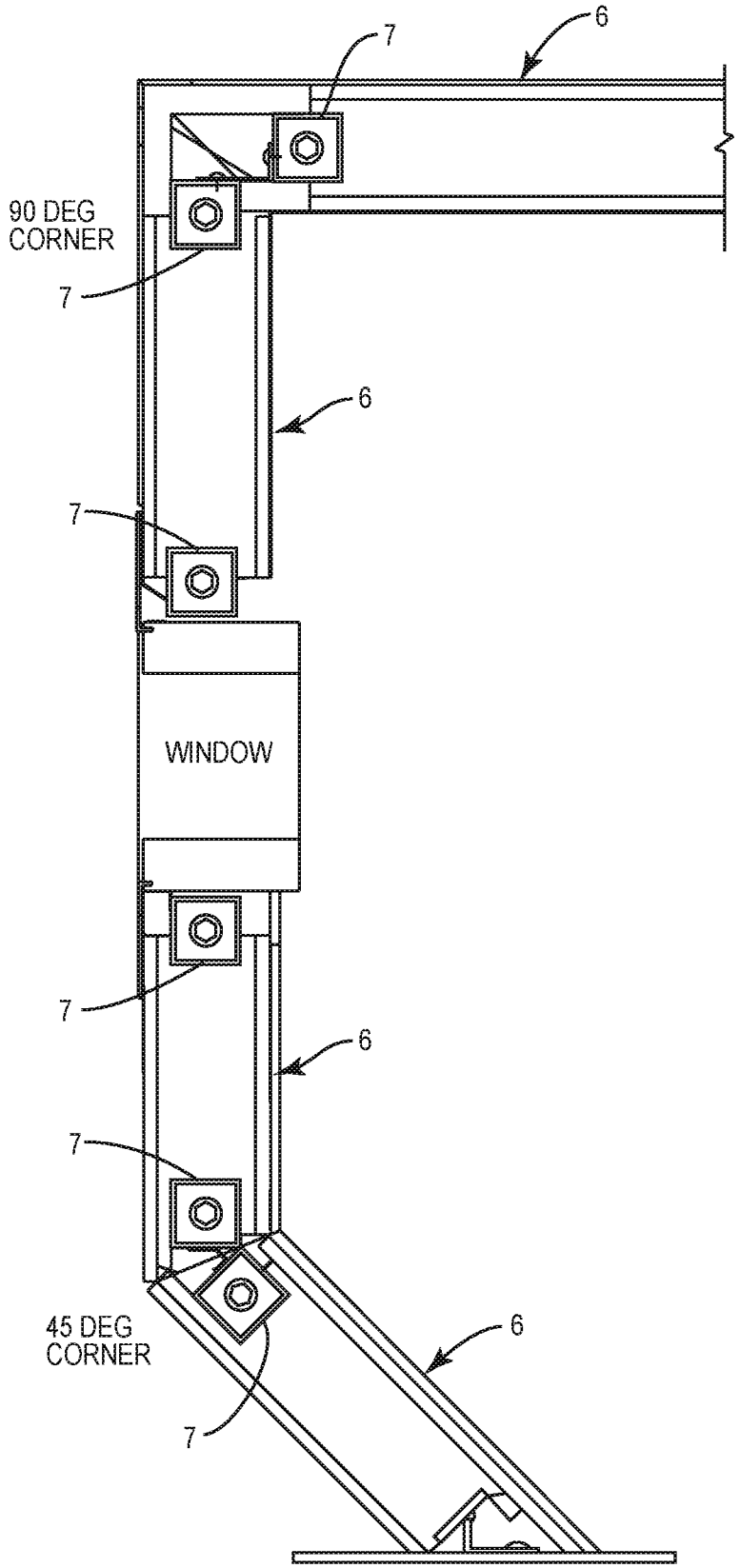
FIG. 4 illustrates a partial top plan view showing layout of a corner of the wall system of the present invention.
Figure 5:
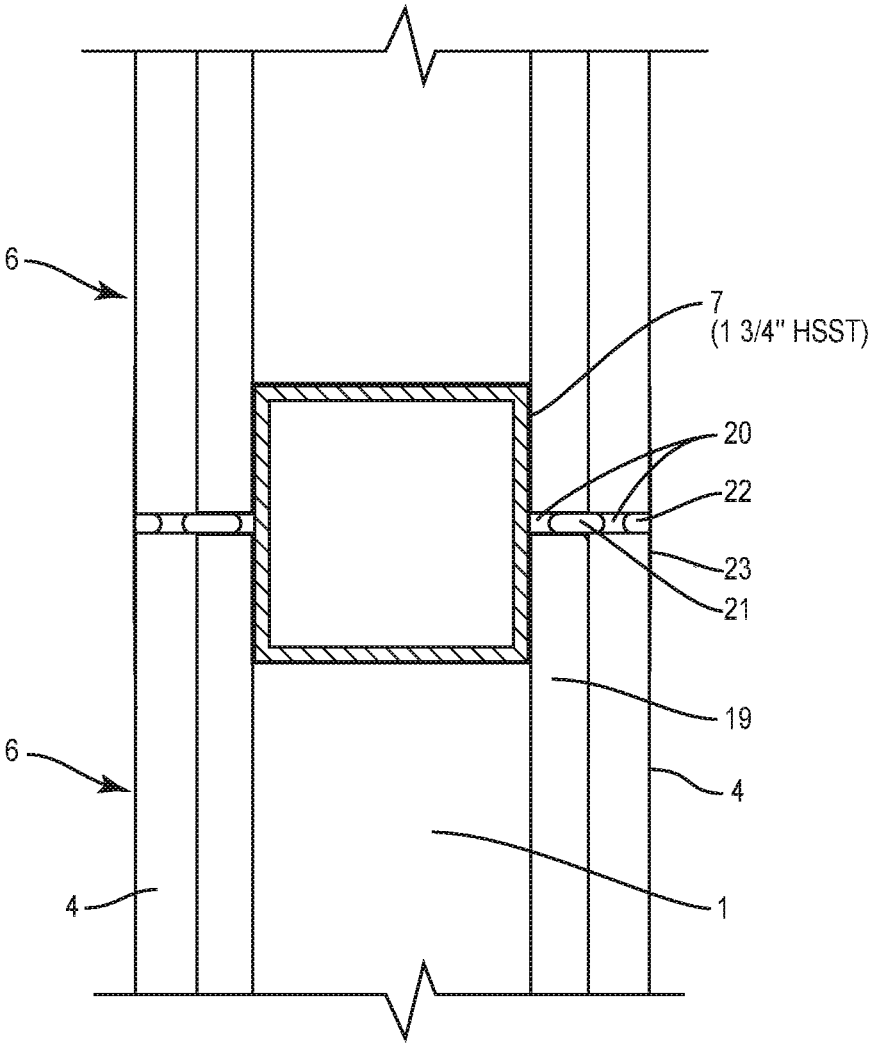
FIG. 5 illustrates an enlarged partial top plan view illustrating sealing of joints formed between adjacent sandwich panels of the wall system.

As shown in FIG. 4, by arranging the channel sill to desired 45 and 90 degree or any other angle and positioning the vertical HSSTs 7 close to the angles, any wall configuration can be achieved. The panels 6 adjacent the corners can have extended outer boards 4 to close out the open angle or can have a separate close out panel.

Depending on the thicknesses of the panel 6 and the horizontal and vertical HSSTs 8 and 7, the depth of the joint will be determined but will generally be ½" to 1" deep, and will be sealed in multiple steps. In addition, the notch 5 on the inner insulating board 1 allows the force of assembly created by the bolts 11 and 16 to automatically bring the outer surface of boards 4 in adjacent panels to an aligned flush surface along the length of the wall.

Various sealing methods can be used to create a seamless wall surface. Reference numeral 20 denotes caulking/sealant, reference numeral 21 denotes an optional backer rod, reference numeral 22 denotes a joint compound and reference numeral 23 denotes a mesh tape and a further coating of joint compound. Thus a complete seamless wall system is easily assembled and installed, with panels 6 themselves never being punctured.

The preceding description of the present invention is merely exemplary, and not intended to limit the scope thereof in any way.

What is claimed is:

1. A wall system comprising a composite sandwich panel (6) comprising an inner board (1) formed of rigid insulating material and having a notch or channel (5) extending around a periphery thereof, and an outer board (4) laminated to the inner board (1), a channel sill (13) configured to receive the composite sandwich panel (6), hollow steel structural tubes (7, 8) configured to vertically and horizontally abut the composite sandwich panel (6) when the composite sandwich panel (6) and vertically-arranged structural tube (7) are received in the channel sill (13), wherein the horizontally-arranged structural tube (8) comprises endplates (9, 10) welded to opposite ends thereof, a stepped washer (12), a bolt (11) configured to secure the stepped washer (12) to the vertically-arranged structural tube (7), one (10) of said endplates (9, 10) comprising a keyhole configured to slide over the stepped washer (12) to be secured to the respective vertically-arranged structural tube (7), and an opposite endplate (9) of said endplates (9, 10) having a rounded hole configured to receive the keyhole of another endplate (10).

2. The wall system of claim 1, additionally comprising a scrim (2) laminated to at least one side of the inner board (1).

3. The wall system of claim 2, additionally comprising an adhesive (3) laminating the scrim (2) to the inner board (1).

4. The wall system of claim 3, wherein the scrim is laminated to both sides of the inner board (1) with the adhesive (3) and two outer boards (4) being laminated to opposite sides of the inner board (1).

5. The wall system of claim 1, additionally comprising a tongue insert (15) configured to be inserted into the notch or channel (5) of the inner board (1).

6. The wall system of claim 1, wherein the vertically-arranged structural tube (7) comprises a series of pre-drilled holes, and additionally comprising a set of bolts (14) configured to attach the vertically-arranged structural tube (7) to the channel sill (13).

* * * * *